US006668817B2

(12) United States Patent
Staker

(10) Patent No.: US 6,668,817 B2
(45) Date of Patent: Dec. 30, 2003

(54) CHUCKABLE NATURAL STONE TILE EDGE CHIPPING TOOL

(76) Inventor: Michael L. Staker, 1235 East 1200 North, Orem, UT (US) 84097

( * ) Notice: Subject to any disclaimer, the term of this patent is extended or adjusted under 35 U.S.C. 154(b) by 39 days.

(21) Appl. No.: 10/086,463

(22) Filed: Feb. 28, 2002

(65) Prior Publication Data

US 2003/0159686 A1 Aug. 28, 2003

(51) Int. Cl.[7] ..... B28D 7/04; B24B 23/00
(52) U.S. Cl. ..... 125/36; 451/358; 451/44
(58) Field of Search ..... 125/36; 451/358, 451/360, 352, 44, 344; 30/164.5, 164.6, 164.7, 164.8

(56) References Cited

U.S. PATENT DOCUMENTS

| | | | | |
|---|---|---|---|---|
| 2,554,763 A | * | 5/1951 | Wickman | 451/358 |
| 3,381,418 A | * | 5/1968 | Eisbrenner | 451/358 |
| 3,656,920 A | * | 4/1972 | Helms | 451/358 |
| RE29,108 E | * | 1/1977 | Atwater | 451/358 |
| 5,243,790 A | | 9/1993 | Gagne | |
| 5,595,170 A | | 1/1997 | Lupi | |
| 5,669,744 A | | 9/1997 | Hines | |
| 5,765,615 A | | 6/1998 | Chapman et al. | |
| 5,787,588 A | | 8/1998 | Tisbo et al. | |
| 5,906,244 A | | 5/1999 | Thompson | |
| 5,910,202 A | | 6/1999 | DeMare | |
| 5,947,103 A | | 9/1999 | Saccon | |
| 5,947,806 A | * | 9/1999 | Rhoads | 451/358 |
| 6,199,545 B1 | | 3/2001 | Adamson | |
| 6,299,518 B1 | | 10/2001 | Daggett | |

FOREIGN PATENT DOCUMENTS

| | | |
|---|---|---|
| JP | 08053411 | 9/1997 |

* cited by examiner

*Primary Examiner*—Dung Van Nguyen
(74) *Attorney, Agent, or Firm*—Angus C. Fox, III

(57) ABSTRACT

A method and tool for chipping the edges of natural stone tile may be used to give the tile a used or rustic appearance. The tool includes an axially-rotatable, cylindrical member having an array of studs affixed or embedded in the cylindrical surface. A drive shaft, affixed to one end of the cylindrical member, may be inserted within the chuck of a powered drill motor or other similar powered device. A handle is rotatably coupled to the opposite end of the cylindrical member. For a preferred embodiment of the invention, the handle consists of a tubular sleeve which is rotatably mounted on bearing races over a support shaft that is rigidly and coaxially affixed to the cylindrical member. In order to use the tool, the drive shaft is secured within the chuck of a drill motor or other similar device designed to provide powered rotary motion to a shaft. With the operator holding both the drill motor and the handle of the chipping tool, the rotating studded cylindrical member is moved along and against the edge of a piece of natural stone tile. The edge of the tile is thereby chipped or abraded.

20 Claims, 3 Drawing Sheets

CHUCKABLE NATURAL STONE TILE EDGE CHIPPING TOOL

BACKGROUND OF THE INVENTION

1. Field of the Invention

This invention relates to tools used for shaping and cutting tile and, more particularly, to tools used to chipping natural stone tile.

2. Description of Related Art

Natural stone tile is widely used for decorative floors. Natural stone tile may be manufactured from a variety of naturally-occurring materials, such as marble, granite, slate, flagstone, onyx, and sandstone. As is the case with denim jeans, it has become fashionable to use natural stone tile which has a used, or rustic appearance. Natural stone tile is often given a rustic appearance by placing the tile in a large drum filled with small stones. When the drum is rotated, the stones abrade the edges of the tile, giving the edges a rounded and worn appearance. This is obviously an expensive, labor-intensive process, which can result in a near doubling of the price of the tile. The increase in cost is related not only to the additional labor required to treat the tile, but is also related to the cost of the equipment required by the rustication process. Because natural stone tile is of generally uniform composition throughout its entire thickness, the rustication process does not remove or damage a protective coating, such as the glass layer that is present on fired ceramic tile.

What is needed is a relatively inexpensive, portable, simple-to-use tool which can be employed by an installer of tile to abrade the edges of each piece of tile prior to the installation thereof. It would be desirable that such a tool would provide an appearance similar to that achieved by the more costly rotating drum process. Such a tool would also have a flexibility advantage over use of the rotating drum process, as small quantities of tile could be treated in a cost-effective manner.

SUMMARY OF THE INVENTION

The present invention provides both a method and an apparatus, or tool, for chipping the edges of natural stone tile in order to give the tile a used or rustic appearance. The tool comprises an axially-rotatable, cylindrical member having an array of studs affixed or embedded in the cylindrical surface. A drive shaft, affixed to one end of the cylindrical member, may be inserted within the chuck of a powered drill motor or other similar powered device. A handle is rotatably coupled to the opposite end of the cylindrical member. For a preferred embodiment of the invention, the handle consists of a tubular sleeve which is rotatably mounted on bearing races over a support shaft that is rigidly and coaxially affixed to the cylindrical member. Alternatively, the cylindrical member may have a hollow cylindrical recess at the handle end thereof, and a handle may be rotatably mounted within the recess in bearing races.

The studs may be affixed to the cylindrical member in various ways. For one embodiment of the invention, the studs are domed globs of welded material. For another embodiment, the studs are tungsten carbide inserts, each of which is mounted within a recess formed within the cylindrical member. The inserts may be affixed within the recesses with brazing compound or with an epoxy adhesive. For yet another embodiment of the invention, the studs are integral with the cylindrical member, being, for example, investment cast, sand cast, or forged as a unit.

In order to use the tool, the drive shaft is secured within the chuck of a drill motor or other similar device designed to provide powered rotary motion to a shaft. With the operator holding both the drill motor and the handle of the chipping tool, the rotating studded cylindrical member is moved along and against the edge of a piece of natural stone tile. The edge of the tile is thereby chipped or abraded. The amount of material removed from the edge may be controlled by varying the amount of time and pressure. The angle can be varied over several strokes, thereby imparting a roughly curved edge to the tile. Using the tool and method, up to three 12-inch-square tile may be treated per minute.

PREFERRED EMBODIMENT OF THE INVENTION

The present invention provides both a method and an apparatus, or tool, for chipping the edges of natural stone tile in order to give the tile a used or rustic appearance. The tool will now be described with reference to the attached drawing figures.

Figure 1:
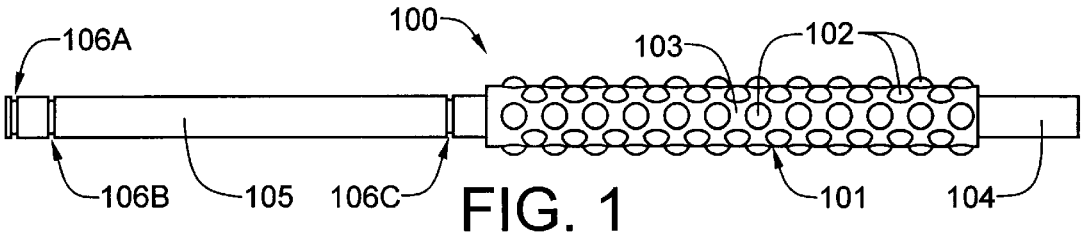
FIG. 1 is a side elevational view of the chipping tool body.

Referring now to FIG. 1, the tool comprises a tool body 100, which includes an axially-rotatable, cylindrical chipping member 101 having an array of studs 102, arranged in rows, which are either integral with, affixed or embedded in the cylindrical surface 103. A drive shaft portion 104, affixed to one end of the cylindrical chipping member 101, may be inserted within the chuck of a powered drill motor or other similar powered device. A handle shaft portion 105, on which a handle may be axially rotatably mounted, is affixed to the opposite end of the cylindrical chipping member 101. It will be noted that the handle shaft 105 has three snap-ring grooves 106A, 106B and 106C machined or ground therein. For a preferred embodiment of the invention, the tool body is made of steel, which may be heat treated for durability and strength. The studs may be affixed to the cylindrical member in various ways. For one embodiment of the invention, the studs are domed globs of welded material. For another, the tool body and studs are investment cast, sand-cast, or forged as a unit. For another, the tool body 100 and studs 102 are also unitary, having been machined or ground from a steel billet.

Figure 2:
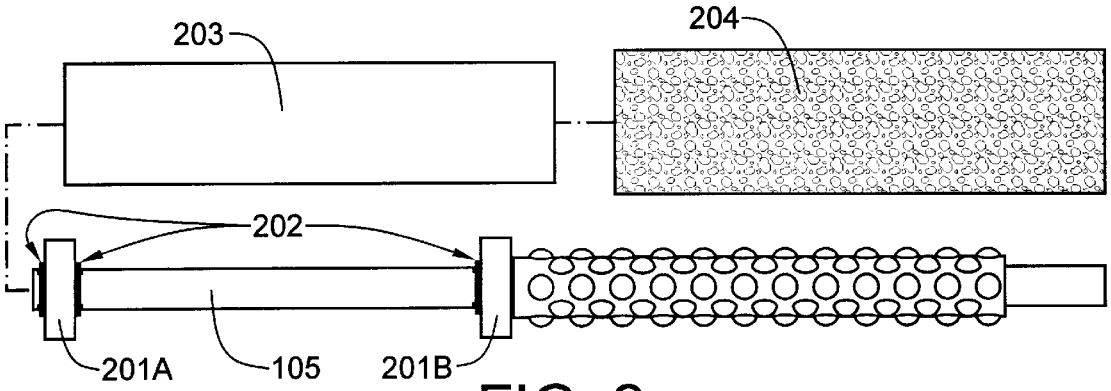
FIG. 2 is an exploded view of view of the chipping tool body fitted with ball bearing races, a sleeve, and a padded grip.

Referring now to FIG. 2, an exploded view of the tool shows the tool body 100 of FIG. 1 fitted with a pair of ball-bearing assemblies 201A and 201B. External snap rings 202, which fit into are employed to retain the ball-bearing assemblies 201A and 201B at the appropriate locations on the handle shaft 105. A handle sleeve 203 slides over the ball-bearing assemblies 201A and 201B. The handle sleeve is preferably made from steel tubing. A handle grip 204, which for a preferred embodiment of the invention is made of polymeric foam material, slips over the handle sleeve 203.

Figure 3:
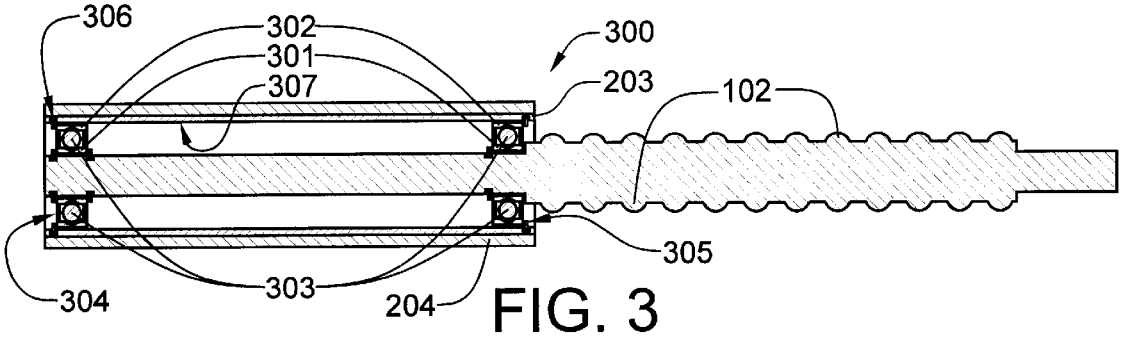
FIG. 3 is a cross sectional view of the assembled chipping tool, taken through a plane which passes through the longitudinal axis of the tool body.

Referring now to FIG. 3, the cross-sectional view of the assembled tool 300 shows the shape of the studs 102 on the cylindrical chipping member 101, as well as the details of the ball-bearing assemblies 201A and 201B. Each ball-bearing assembly 201A and 201B has both an inner race 301 and an outer race 302, between which a plurality of ball-bearings 303 are positioned. As the tool will be used for a job which necessarily will generate dust and grit, the ball-bearing assemblies 201A and 201B are of the sealed type. Each ball-bearing assembly 201A and 201B has a dust seal 304 on each side of the ball bearings 303. As is typical for such an application, the dust seals 304 are affixed to the outer ball-bearing race 302. Each dust seal 304 is washer shaped, having a central aperture, and each end of the inner ball-bearing race 301 spins within the central aperture of a dust seal 304. Also shown in this cross-sectional view is the handle sleeve 203, which has been slipped over the outer bearing races 302 of each ball-bearing assembly 201A and 201B. Internal snap rings 305, which fit into grooves 306 machined in the inner circumferential surface 307 of the handle sleeve 203, maintain proper positioning of the handle sleeve 203. The handle grip 204 is shown installed over the upper surface of the handle sleeve 203. The handle grip 204 is preferably sized so that its internal diameter is less than the external diameter of the handle sleeve 203. As the handle grip 204 is preferably made of an expandable material, it may be slipped over the handle sleeve 203 using a mixture of water and liquid detergent. After the water evaporates, the grip 204 is firmly affixed to the handle sleeve 203.

Figure 4:
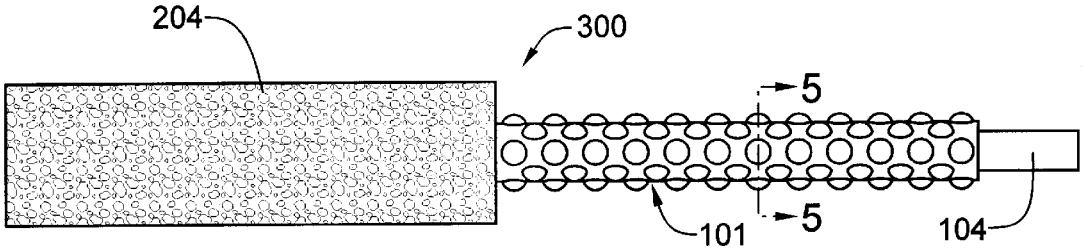
FIG. 4 is a side elevational view of the assembled chipping tool.

Referring now to FIG. 4, the chipping tool 300 is shown completely assembled. The handle shaft portion 105 of the tool body 100 is covered by the handle sleeve 203 and the handle grip 204.

Figure 5:
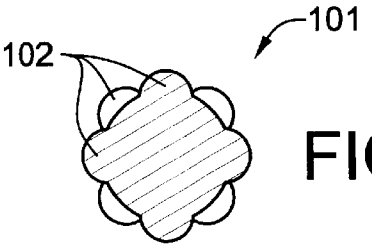
FIG. 5 is a cross sectional view of the cylindrical member of the tool body, taken through section line 5—5 of FIG. 4.

Referring now to FIG. 5, a cross-sectional view through the cylindrical chipping member 101 shows the staggered arrangement of the various rows of studs 102, which combine to make the array.

Figure 6:
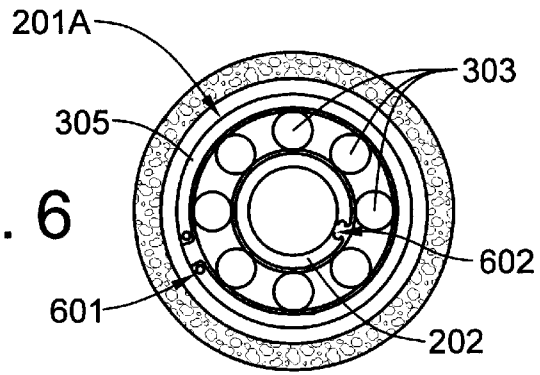
FIG. 6 is a handle-end view of the assembled tool, taken perpendicular to the longitudinal axis of the tool body.

Referring now to FIG. 6, the handle end of the tool is shown with the outer dust seal 304 removed from the ball-bearing assemblies 201A and 201B to show the structure thereof. Also not shown are the ball-bearing retainers which maintain the ball bearings 303 radially spaced about the axis of the ball-bearing assembly 201A. As the structure of ball-bearing assemblies is well known in the art and is not the focus of this invention, these details have been eliminated from the drawings. It will be noted that the internal snap ring 305 is equipped with installation/removal holes 601 for compressive snap ring pliers (not shown), while the external snap ring 202 is equipped with installation/removal recesses 602 for extensive snap ring pliers (also not shown).

Figure 7:
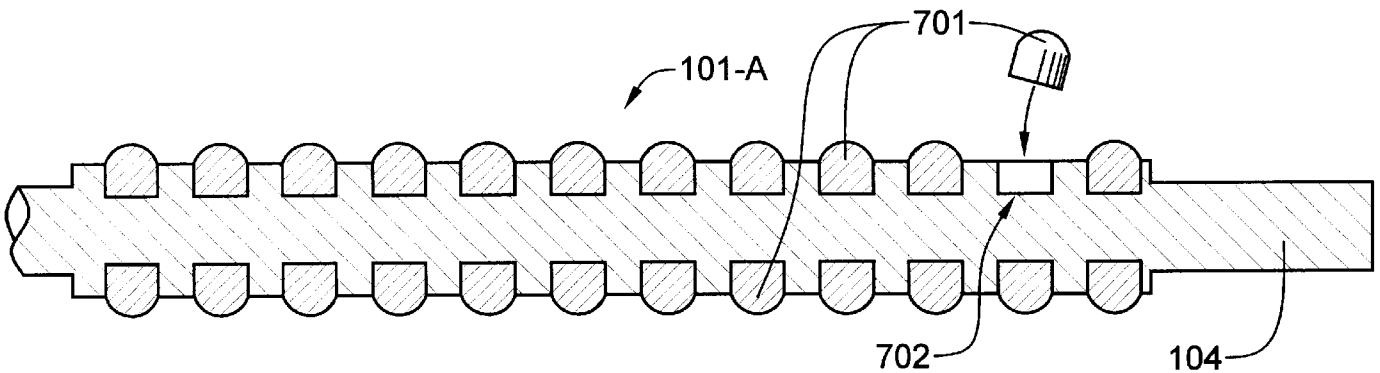
FIG. 7 is a cross sectional view of the drive shaft portion and integral cylindrical member portion of an alternative embodiment of the tool having embedded studs.

Referring now to FIG. 7, an alternative embodiment 101-A of the cylindrical chipping member of the tool body 100 is shown. Each stud 701 is embedded within an the internal snap ring 305 is equipped with installation/removal holes 601 for compressive snap ring pliers (not shown), while the external snap ring 202 is equipped with installation/removal recesses 602 for extensive snap ring pliers (also not shown).

Referring now to FIG. 7, an alternative embodiment 101-A of the cylindrical chipping member of the tool body 100 is shown. Each stud 701 is embedded within an aperture 702 within the cylindrical chipping member 101-A. The studs are preferably made of a wear-resistant material, such as tool steel or tungsten carbide. Each of the studs 701 may be affixed within its associated aperture 702 by one several well-known techniques, such as brazing, epoxy bonding, or crimping of the rim of the aperture 702 against the stud 701.

Figure 8:
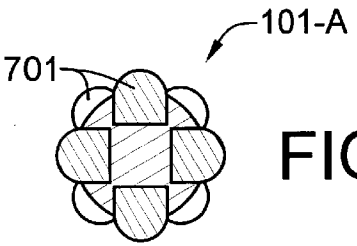
FIG. 8 is a side view of the tool coupled to a drill motor and positioned to abrade the edge of a piece of natural stone tile.

FIG. 8 shows a cross-sectional view of the alternative embodiment cylindrical chipping member 101-A.

Though not presently considered to be the preferred embodiment of the invention, the cylindrical member may have a hollow cylindrical recess at the handle end thereof, and a handle may be rotatably mounted within the recess in bearing races.

Figures 9, 10, 11:
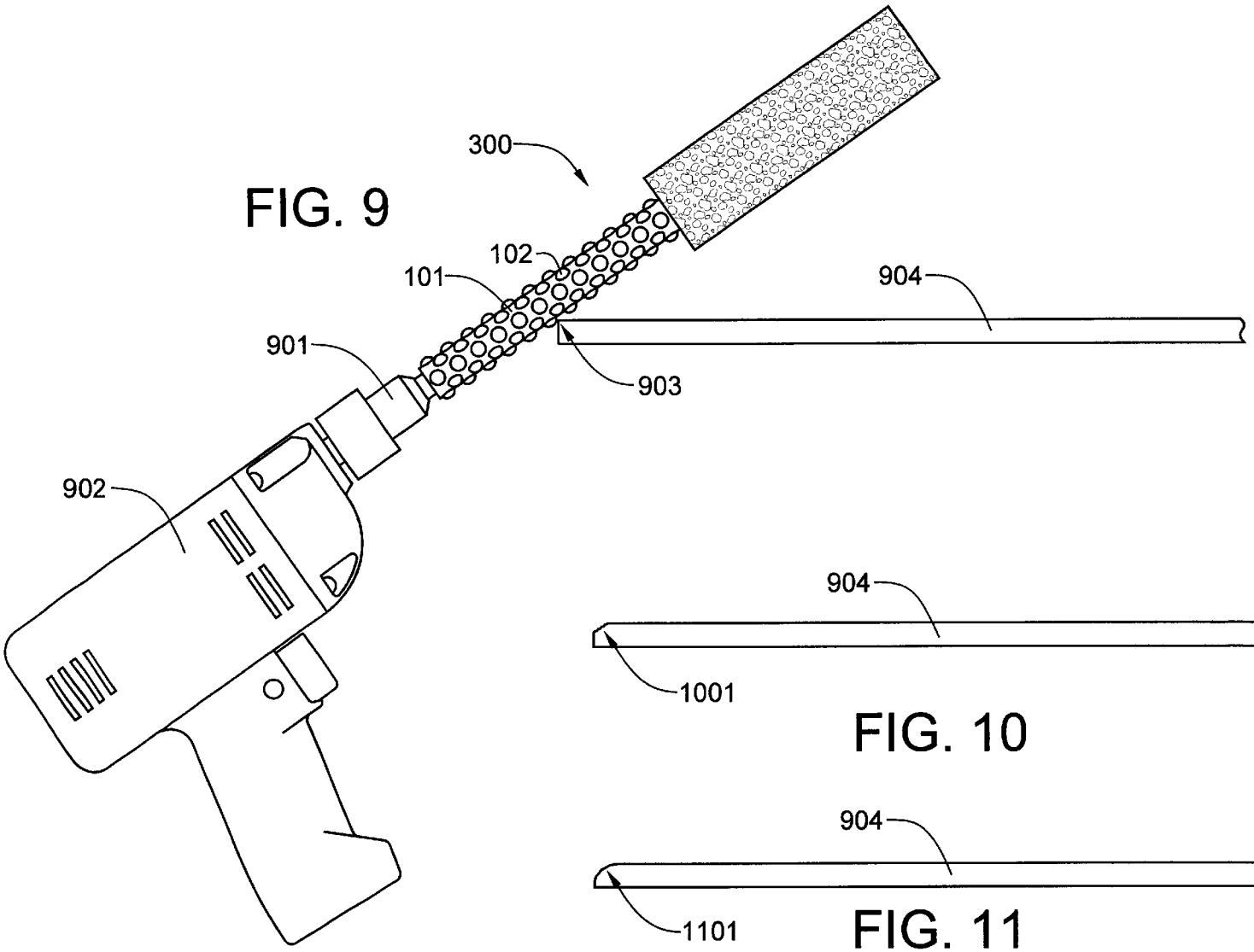
FIG. 9 is a piece of stone tile, the edge of which has been chipped using the tool.
FIG. 10 shows a piece of tile 904, an edge of which has been abraded to form a generally chamferred profile 1001 using the tool 300.
FIG. 11 shows a piece of tile 904, an edge of which has been abraded to form a generally rounded profile 1101 using the tool 300.

Referring now to FIG. 9, the tile chipping tool 300 is coupled to the chuck 901 of a drill motor 902 or other similar powered drive, and positioned to abrade the edge 903 of a piece of natural stone tile 904. The operator secures the tile in a vice or other clamp, holds the drill motor 902 in one hand, and the grip-covered rotatable handle sleeve 203 in the other hand. With the drill motor operating and rotating the tool, the cylindrical chipping member 101 is held against the edge 903 of the tile 904 and moved back and forth against the edge 903. The edge 903 of the tile 904 is chipped or abraded through contact with the studs 102. Particles of the tile 904 may be removed from each of the four edges 903 thereof, thereby providing a rustic appearance for the tile 904. The amount of material removed from the edge 903 may be controlled by varying the amount of time and pressure with which the cylindrical chipping member 101 is held against the edge as it rotates. The angle can be varied over several strokes, thereby imparting a roughly curved edge to the tile. Using the tool and method, up to three 12-inch-square tile may be treated per minute.

FIG. 10 shows a piece of tile 904, an edge of which has been abraded to form a generally chamferred profile 1001 using the tool 300.

FIG. 11 shows a piece of tile 904, an edge of which has been abraded to form a generally rounded profile 1101 using the tool 300.

Although only a single embodiment of the chuckable, natural stone tile edge chipping tool has been disclosed herein, it will be obvious to those having ordinary skill in the art that changes and modifications may be made thereto without departing from the scope and the spirit of the invention as hereinafter claimed.

What is claimed is:

1. A natural stone tile edge chipping tool comprising:

a cylindrical chipping member having an array of studs affixed to an external surface thereof, said cylindrical chipping member also having a longitudinal rotational axis;

a drive shaft coaxially affixed to a first end of the cylindrical chipping member, said drive shaft couplable to a chuck of a hand-held drill motor; and a handle affixed to the other end of the cylindrical chipping member, said handle being coaxially rotatable with and independently of the cylindrical chipping member.

2. The tool of claim 1, wherein said cylindrical chipping member comprises a cylindrical body and a plurality of studs, each stud being a glob of metal welded to the cylindrical body.

3. The tool of claim 1 wherein the cylindrical chipping member and affixed studs are manufactured as a unit via investment casting.

4. The tool of claim 1 wherein the cylindrical chipping member and affixed studs are manufactured as a unit via sand casting.

5. The tool of claim 1, wherein the cylindrical chipping member and affixed studs are manufactured as a unit via a forging process.

6. The tool of claim 1, wherein the cylindrical chipping member and affixed studs are manufactured as a unit from a steel billet.

7. The tool of claim 1, wherein said handle comprises:

a handle shaft affixed to a second end of the cylindrical chipping member, said handle shaft being coaxial with the cylindrical chipping member;

at least a pair of ball-bearing assemblies positioned on the handle shaft; and a handle sleeve slipped over the ball-bearing assemblies and rotatable coaxially with respect to the handle shaft.

8. A tool for abrading edges of natural stone tile, said tool comprising:

a cylindrical chipping member rotatable about its axis, said chipping member having an array of studs affixed to an external surface thereof;

a drive shaft coaxially affixed to one end of the cylindrical chipping member, said drive shaft couplable to a chuck of a hand-held drill motor, which provides rotary motion to the drive shaft and cylindrical chipping member on demand; and a handle shaft affixed to an opposite end of said cylindrical chipping member;

a handle sleeve coaxially mounted over said handle shaft, said handle sleeve being rotatable coaxially and independently with respect to the chipping member.

9. The tool of claim 8, wherein said handle shaft and said handle sleeve are coupled via at least a pair of ball-bearing assemblies which fit over the handle shaft and are positioned spaced-apart from one another, the handle sleeve sliding over the ball bearing assemblies.

10. The tool of claim 8, wherein the cylindrical chipping member and affixed studs are manufactured as a unit via investment casting.

11. The tool of claim 8, wherein said cylindrical chipping member comprises a cylindrical body and a plurality of studs, each stud being a glob of metal welded to the cylindrical body.

12. The tool of claim 8 wherein the cylindrical chipping member and affixed studs are manufactured as a unit via sand casting.

13. The tool of claim 8, wherein the cylindrical chipping member and affixed studs are manufactured as a unit via a forging process.

14. The tool of claim 8, wherein the cylindrical chipping member and affixed studs are manufactured as a unit from a steel billet.

15. A method of treating natural stone tile to give it a rustic look, said method comprising the steps of:

holding a cylindrical chipping member that is spun about its axis against the edges of the tile, said chipping member having an array of studs affixed to an external surface thereof which abrade material from the edges, as the studs move in rotary motion, striking the edges in succession;

moving the rotating cylindrical chipping member along the edges of the tile to remove a generally uniform amount of material from all edges.

16. The method of claim 15, wherein the cylindrical chipping member is spun about its axis by the powered action of a drill motor, to which it is chucked.

17. The method of claim 16, wherein the cylindrical chipping member is coupled to the drill motor at one end thereof, and to a handle at the other end thereof.

18. The method of claim 17, wherein the handle is rotatable independently and coaxially with respect to the cylindrical chipping member.

19. The method of claim 18, wherein the handle is coupled to the cylindrical chipping member with ball-bearing assemblies.

20. The method of claim 19, wherein said studs are formed from material selected from the group consisting of hardened steel and tungsten carbide.

* * * * *